US008104418B1

(12) United States Patent
Thompson

(10) Patent No.: US 8,104,418 B1
(45) Date of Patent: Jan. 31, 2012

(54) BOAT ANCHORING SYSTEM

(76) Inventor: Larry C. Thompson, Sanibel, FL (US)

( * ) Notice: Subject to any disclaimer, the term of this patent is extended or adjusted under 35 U.S.C. 154(b) by 222 days.

(21) Appl. No.: 12/460,685

(22) Filed: Jul. 23, 2009

(51) Int. Cl.
*E02B 3/24* (2006.01)
*B63B 17/00* (2006.01)

(52) U.S. Cl. ..... 114/230.16; 114/364

(58) Field of Classification Search ..... 440/36, 440/104, 105, 106, 107, 108, 109; 52/155, 52/156; 114/294, 230.15, 230.13, 230.1, 114/295, 255; 248/229.1
See application file for complete search history.

(56) References Cited

U.S. PATENT DOCUMENTS 2,459,355 A * 1/1949 Areaux ..... 440/109
2,907,294 A * 10/1959 Lawler ..... 114/230.1
3,989,216 A * 11/1976 Veatch ..... 248/278.1
5,544,076 A * 8/1996 Wiggerman et al. ..... 702/142
6,220,197 B1 * 4/2001 Pohlman ..... 114/294
7,093,558 B1 * 8/2006 Mandanici ..... 114/361
7,827,927 B2 * 11/2010 Kivi ..... 114/294
7,870,829 B1 * 1/2011 Perry et al. ..... 114/230.1
2007/0034758 A1 * 2/2007 Bates ..... 248/218.4
2009/0293793 A1 * 12/2009 Silver ..... 114/294

* cited by examiner

*Primary Examiner* — Daniel Venne
*Assistant Examiner* — Anthony Wiest
(74) *Attorney, Agent, or Firm* — William E. Noonan

(57) ABSTRACT

An anchoring system for a boat includes a pair of anchor fixtures, each having a base and a tube carried by and extending across the base. A first of the anchor fixtures is mountable proximate the peripheral edge of the vessel with the tube oriented to extend in a generally horizontal direction. The other, second anchor fixture is mounted exteriorly to the transom of other surface of the hull such that the longitudinal axis of the tube extends generally vertically. The first anchor fixture accommodates an adjustable pole holder that has a stem for selectively engaging with the first anchor fixture to provide anchoring, transporting and stowed conditions. A sleeve is interconnected angularly to the stem for holding a first pole, which may be operated by adjusting the pole holder to engage the bottom of the body of water. A second pole is received by the tube of the second anchor fixture to likewise engage the bottom of the body of water such that the boat is anchored thereto.

13 Claims, 14 Drawing Sheets

BOAT ANCHORING SYSTEM

FIELD OF THE INVENTION

This invention relates to a boat anchoring system and, more particularly, to an apparatus for use in combination with one or more elongate push poles to anchor a fishing boat or other shallow water marine vessel to the bottom of a body of water.

BACKGROUND OF THE INVENTION

Recreational shallow water fishing is extremely popular in a wide variety of locations including, but not limited to, lakes, bays, coastal waters, rivers and other waterways. Many types of small and modestly sized boats are used for this activity. The fisherman typically navigates the vessel to a selected destination and then anchors the boat before starting to fish.

Securely anchoring even a small marine vessel such as a flats boat or other shallow water vessel can be quite tedious and time consuming. Usually, a pair of anchors must be separately deployed to effectively hold the boat in place and minimize drift. Conventional anchors, even those for small vessels, tend to be fairly heavy and can be difficult for some persons to drop and retrieve. Such anchors are also apt to become snagged or caught in underwater vegetation and refuse. Moreover, if targeted fish have moved from the selected fishing spot or the position of the boat otherwise needs to be changed, the two anchors must be arduously retrieved and re-dropped in a new location.

Conventional anchor lines present additional problems during inland, coastal or back bay fishing of the type described above. Often, a hooked fish may pull the fishing line such that it strikes one of the deployed anchor lines and breaks. This causes both the fish and fishing tackle to be lost and requires time consuming and aggravating replacement or repair of the lost hook and tackle.

Push poles are widely used on small boats of the type described above for maneuvering and positioning such vessels in a fairly shallow body of water. To date, however, push poles have not been used to anchor the boat for fishing or otherwise.

SUMMARY OF THE INVENTION

It is therefore an object of the present invention to provide an innovative anchoring system that allows small boats, and especially shallow water boats used for coastal, inland and back bay fishing, to be quickly and effectively anchored in place at a selected location in a body of water.

It is a further object of this invention to provide an anchoring system that eliminates the use of conventional anchors currently used with coastal, inland and back bay fishing boats and which overcomes the problems typically exhibited by such anchors.

It is a further object of this invention to provide an anchoring system that is much easier and faster to operate than standard shallow water boat anchors and which does not require arduous lifting and retrieving of a heavy and/or bulky anchor.

It is a further object of this invention to provide an anchoring system that eliminates anchor lines and the commonplace problem of fishing line breakage that occurs when the fishing line strikes the anchor line.

It is a further object of this invention to provide an anchoring system that allows a small boat, and particularly a shallow water fishing boat, to be quickly and effectively repositioned without the hassle and aggravation of having to retrieve and re-drop one or more standard anchors.

It is a further object of this invention to provide an anchoring system that may be installed quickly and securely on a wide variety of smaller and modestly sized shallow water boats and marine vessels.

It is a further object of this invention to provide an anchoring system that may be quickly and effectively adjusted for mounting on various vessel and hull configurations.

It is a further object of this invention to provide an anchoring system employing a unique and innovative anchoring fixture that may be mounted on a variety of horizontal and vertical surfaces of a boat including, but not limited to, the gunwale, deck, hull and transom.

It is a further object of this invention to provide an anchoring system that uniquely utilizes standard push poles or other elongate poles for anchoring a small or modestly sized boat or marine vessel to the bottom of a relatively shallow body of water.

It is a further object of this invention to provide a boat anchoring system featuring an anchoring fixture that is readily and conveniently adjustable for either anchoring the boat, repositioning the boat or stowage as required.

This invention results from a realization that a small or modestly sized shallow water fishing boat may be more quickly, conveniently and effectively anchored by using one or more standard push poles mother elongate poles that are attached to the vessel and extend downwardly into the water to engage the bottom and anchor the vessel in place. This invention results from the further realization that such push poles can be quickly, easily and effectively deployed, adjusted and retrieved by using the anchoring system as described herein.

This invention features an anchoring system for use in combination with an elongate pole to anchor a marine vessel to a bottom of a body of water. The system includes a pair of anchor fixtures, each having a base and a tube carried by and extending across the base. The base of a first one of the anchor fixtures is mountable exteriorly to the vessel proximate a peripheral edge of the vessel with a longitudinal axis of the tube oriented to extend in a generally horizontal direction. The base of the first anchor fixture has a receptacle that is alignable with an underlying opening in the vessel. An adjustable pole holder includes an elongate stem and an elongate pole mounting sleeve joined and extending axially laterally relative to the stem. The pole holder is selectively alternatable between a stowed condition, wherein the stem is inserted through the receptacle and into the underlying opening in the vessel and the sleeve extends laterally relative to the tube of the first anchor fixture, and a deployed condition, wherein the stem is inserted through the tube of the first anchor fixture and the sleeve is held for receiving the elongate pole. The stem is rotatable in the tube of the first anchor fixture in the deployed condition to selectively alternate the sleeve, with a pole received therein, between a generally horizontal axial orientation for transporting the pole and a generally vertical axial orientation for engaging the pole with the bottom of the body of water. The base of the second anchor fixture is mountable exteriorly to a side of the hull of the vessel with a longitudinal axis of the tube of the second anchor fixture oriented to extend in a generally vertical direction such that a respective pole is receivable by the tube and engagable with the bottom of the body of water. Engaging the respective poles with the bottom of the body of water anchors the vessel thereto.

In a preferred embodiment, each tube includes a pair of axially aligned and spaced apart tube segments. The tube segments typically have a cylindrical configuration. Each base may be interconnected to an interior mounting bracket. One such mounting bracket may interiorly engage the gunwale or other generally horizontal surface of the vessel and be secured to the base of the first anchor fixture by one or more connectors that extend through the vessel. A second mounting bracket may interiorly engage the transom or other generally vertical surface of the hull and be secured to the base of the second anchor fixture by one or more connectors that extend through the hull. At least one shim element may be mounted between the base and the vessel surface to which the base mounted. The shim element may include an inclined wedge for adjusting the angular orientation of the tube relative to the vessel surface to which the tube and base are mounted.

The stem and the sleeve may include respective tubular configurations. Preferably, the stem and the sleeve are perpendicularly interconnected.

The first anchor fixture and the stem may include corresponding anchor position locking slots which are alignable for receiving a locking pin to maintain the holder in the anchor position with the sleeve in a generally vertical axial orientation. The anchor fixture and the stem may include corresponding transporting position locking slots that are alignable for receiving a locking pin to maintain the holder in a transporting position with the sleeve in a generally horizontal axial orientation.

A stem extension may be releasably connected to and axially aligned with the stem for being received by the tube of the first anchor fixture to support the sleeve at a selected extended distance outwardly of the edge of the vessel. The stem extension may include a reduced diameter insert that is receivable in an axial bore of the stem to join the stem extension to the stem.

This invention also features, individually, the anchor fixture attached exteriorly to the hull of the vessel as summarized above and an anchor apparatus including both an anchor fixture mounted to the periphery of the vessel and an adjustable pole holder. Each of the exteriorly attached components is for carrying a respective elongate pole that is engaged with the bottom to anchor the boat.

DETAILED DESCRIPTION OF PREFERRED EMBODIMENTS

Other objects, features and advantages will occur from the following description of a preferred embodiment and the accompanying drawings, in which.

Figure 17:
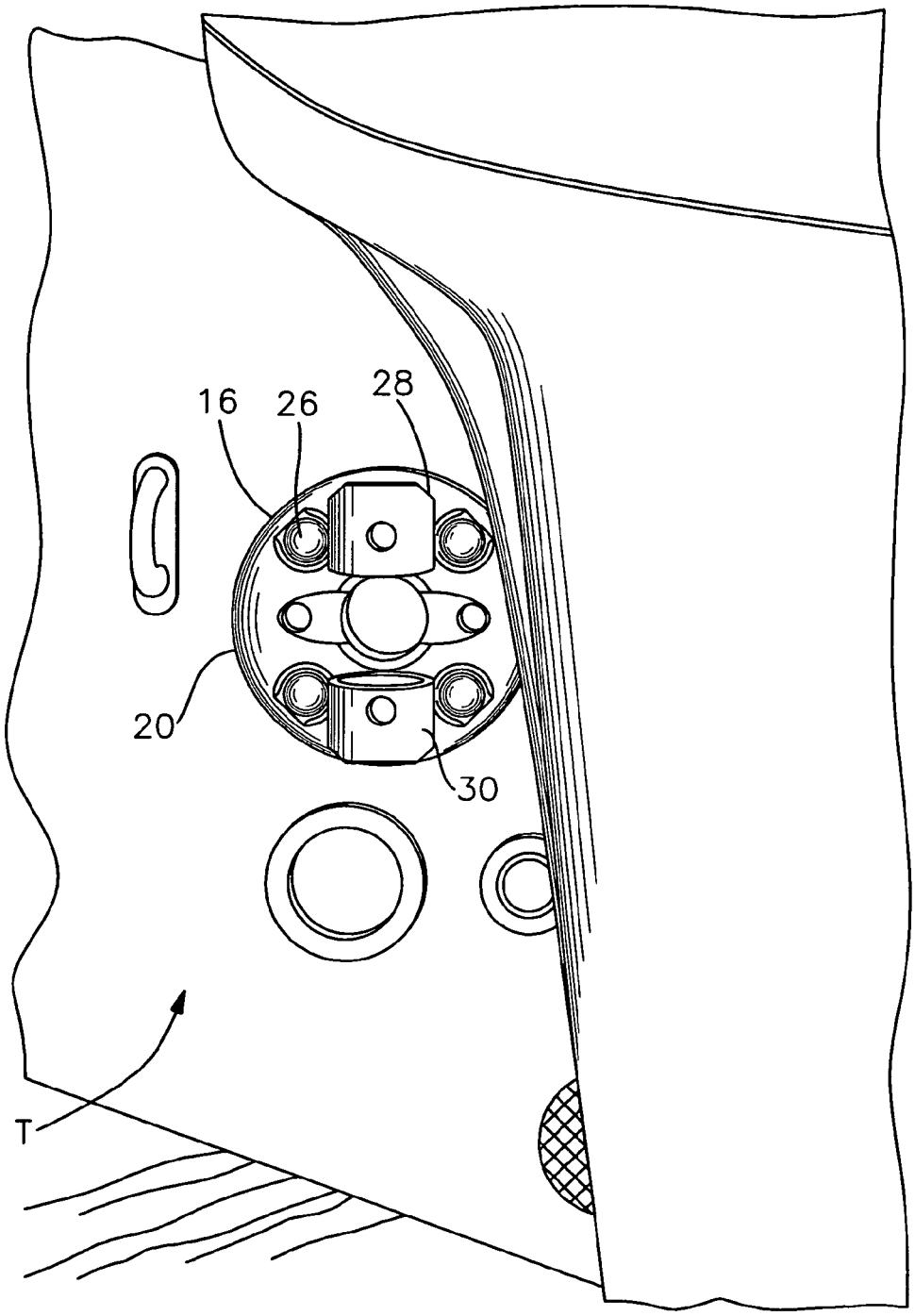
Figure 18:
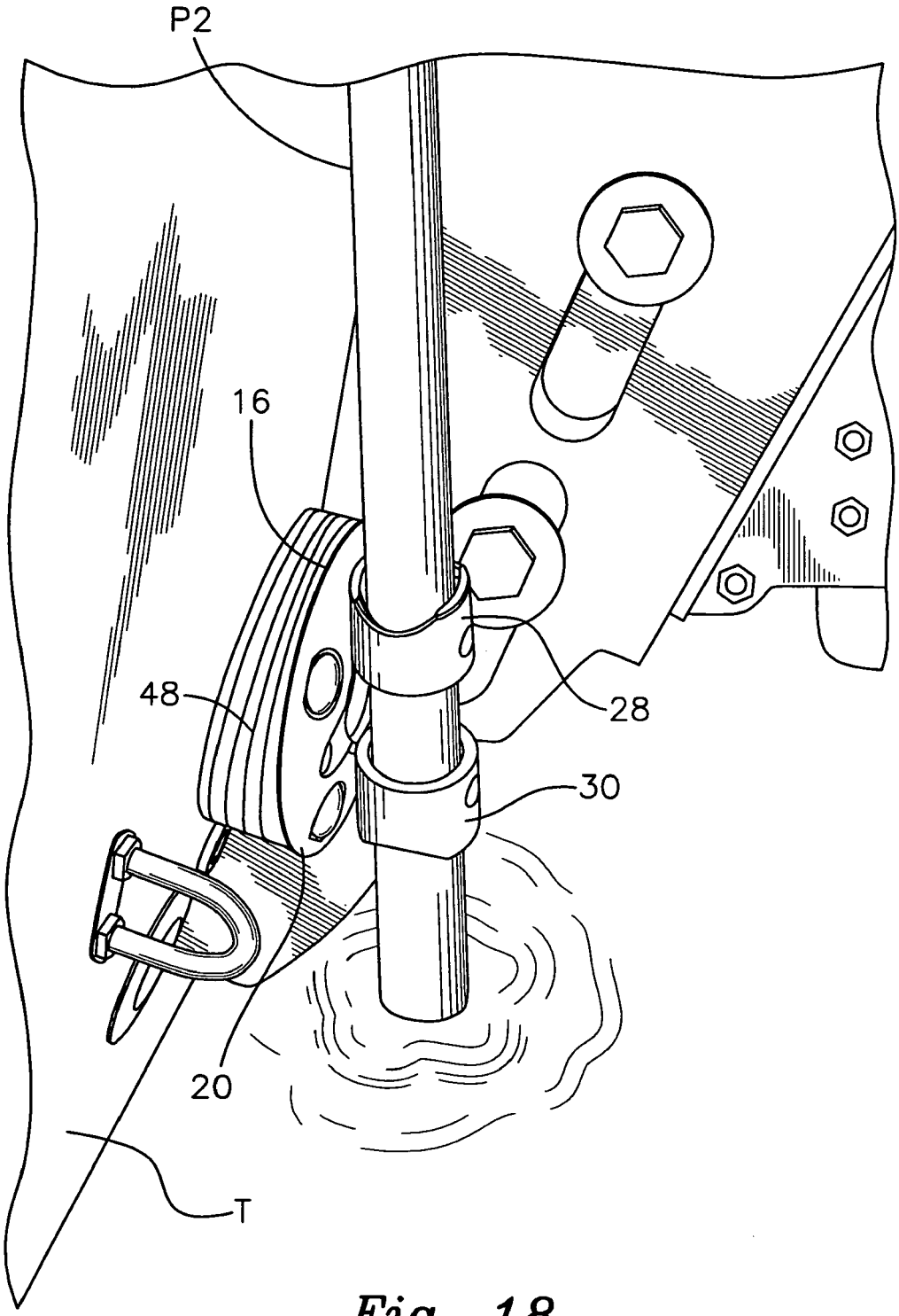

FIG. 17 is a perspective view of the anchor fixture secured to the transom of a boat and with the tube segments oriented such that they are capable of receiving a respective push pole vertically through the fixture; and FIG. 18 is a perspective view of the transom mounted anchor fixture, which is angularly adjusted using a plurality of inclined shims and which accommodates a push pole for engaging the bottom of a body of water and helping to anchor the vessel thereto.

Figure 1:
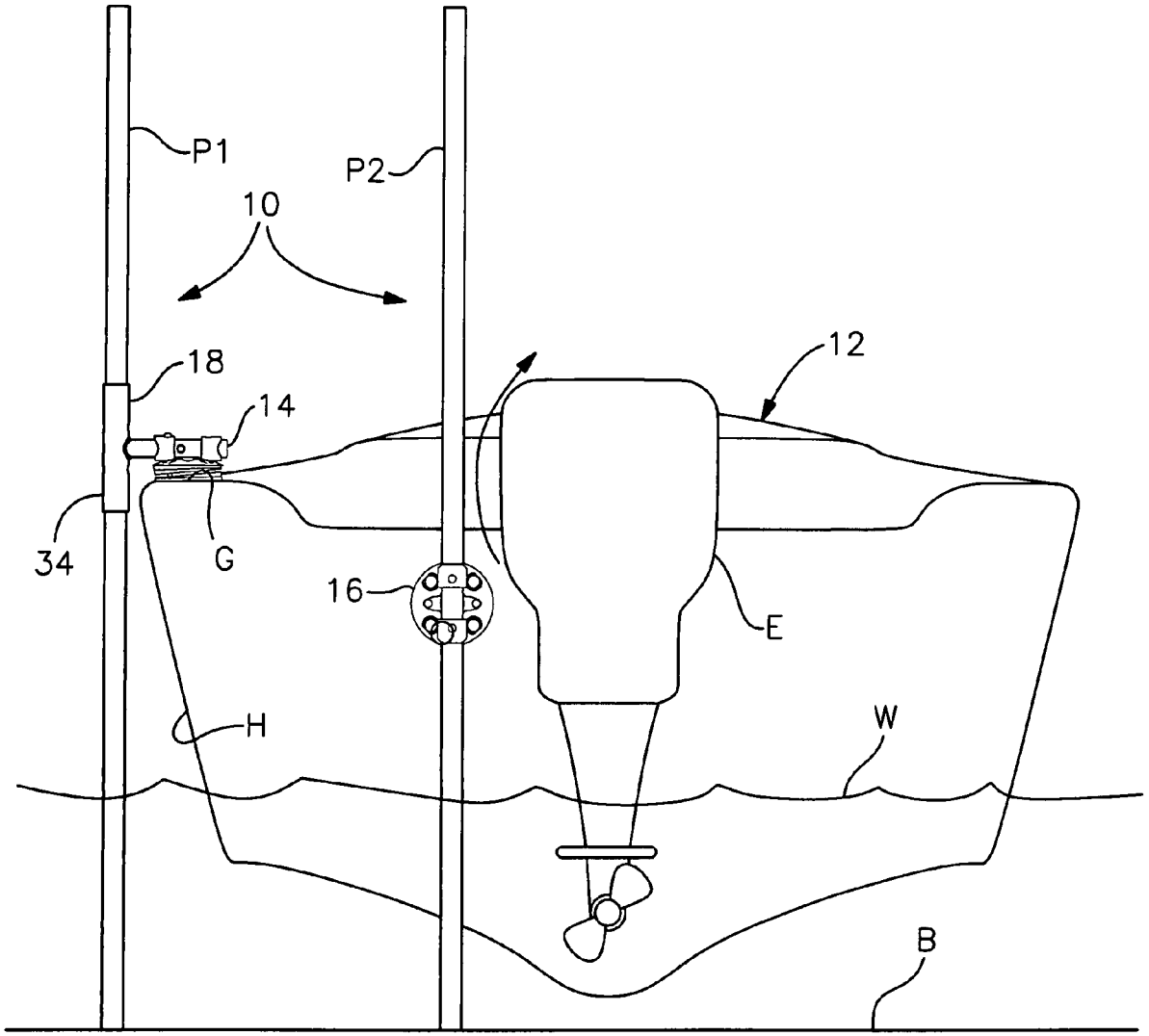
FIG. 1 is an elevational rear view of a boat equipped with the anchoring system of this invention, which anchoring system is deployed to anchor the boat to the bottom of a shallow body of water.

There is shown in FIG. 1 a system 10 for anchoring a boat 12 to the bottom B of a relatively shallow body of water W. It should be understood that system 10 may be used for securely and conveniently anchoring a wide variety of boats and marine vessels of assorted sizes and types. However, the invention is especially suited for use in anchoring small fishing boats such as flats boats, sports boats and other types of shallow water fishing boats. Anchoring system 10 is particularly effective for use in shallow water environments such as inland waterway, back bay, coastal and lake locations. Essentially, the invention may be used in any type of marine environment wherein an elongate push pole can be used to maneuver and position the boat in the water as needed and desired.

Anchor system 10 features an adjustable anchor apparatus 14 mounted to the gunwale G, deck or hull of boat B proximate the edge of the boat. System 10 also includes an anchor fixture 16 mounted to hull H, and, more particularly, to the transom T at the stern of boat 12 adjacent boat engine E. The precise positioning of apparatus 14 and fixture 16 on the boat may be varied within the scope of this invention. Each of anchor apparatus 14 and anchor fixture 16 supports a respective push pole P1, P2 in a substantially vertical condition for engaging the bottom B of body of water W and anchoring boat 12 in a selected location. The detailed construction of apparatus 14 and fixture 16, as well as the manner in which these components cooperate with the respective poles are described more fully below. Push poles P1, P2 comprise standard push poles which are commonly used in the shallow water boat industry for maneuvering and positioning vessel 12. Alternative types of elongate poles may also be used. Essentially, each pole should be long enough to extend vertically from a height above hull H to the bottom B of shallow body of water W. The lower end of each pole should be capable of being manually forced or driven into the bottom and thereby held in place to anchor the boat.

Figure 2:
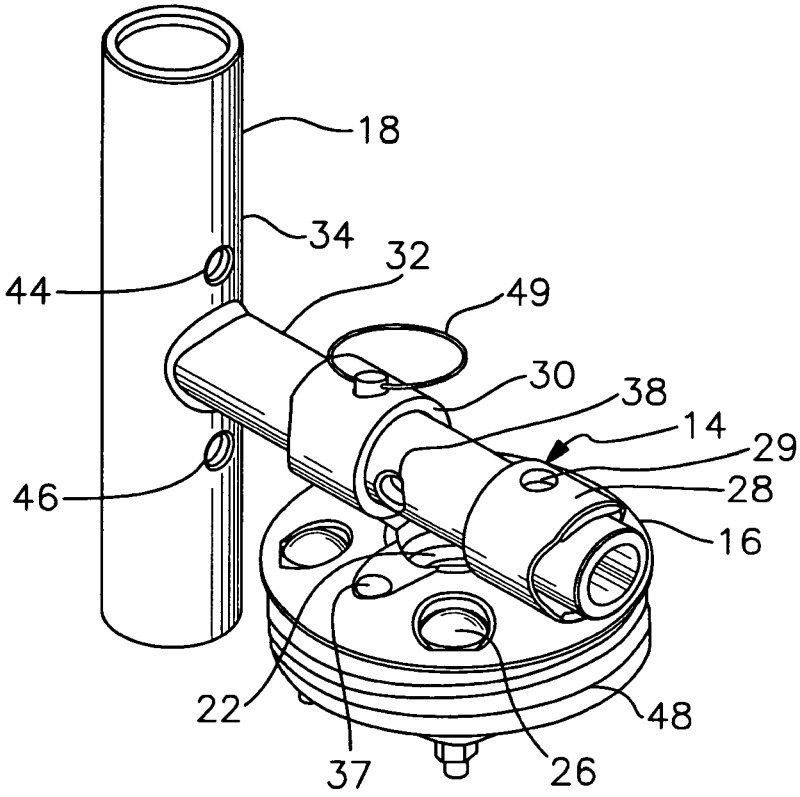
FIG. 2 is a perspective view of an adjustable anchoring apparatus used in the anchoring system; the apparatus is mounted to the gunwale, deck or other horizontal surface proximate a peripheral edge of the vessel.
Figure 3:
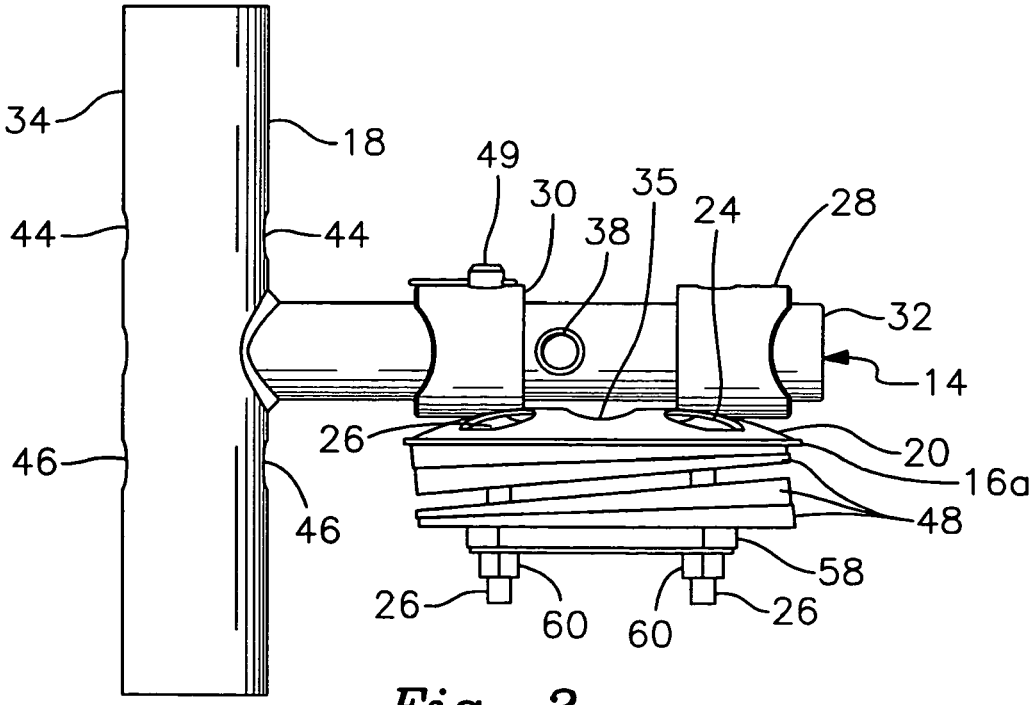
FIG. 3 is a side elevational view of the apparatus of FIG. 2.
Figure 4:
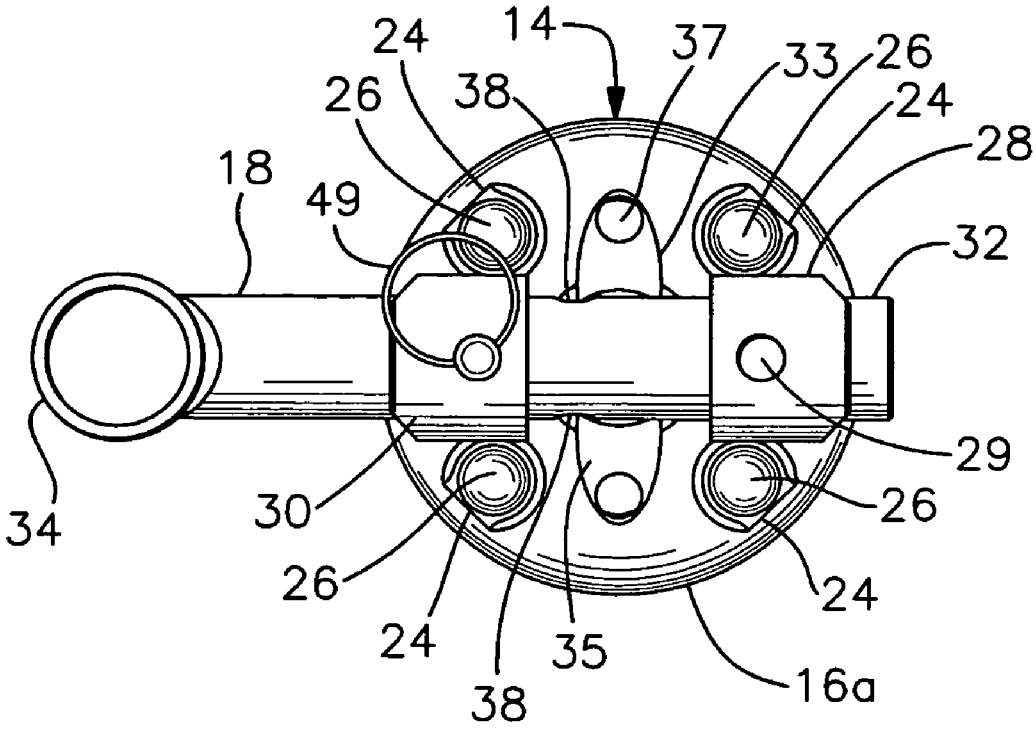
FIG. 4 is a top plan view of the apparatus of FIGS. 2 and 3.

As shown in FIGS. 2-4, anchor apparatus 14 includes an anchor fixture 16*a*, which is constructed identically or at least very similarly to the anchor fixture 16 mounted to the transom of the vessel. Apparatus 14 further includes a pole holder 18 that is adjustably mounted to fixture 16*a* for accommodating an elongate push pole P1 (FIG. 1) in any one of a number of selected conditions described more fully below. Both the anchor fixture and the adjustable pole holder, as well as all other structural components described in this invention are typically composed of stainless steel or other rust resistant marine grade materials capable of withstanding prolonged exposure to a harsh and corrosive marine environment. Various alternative types of rugged and durable metals, metal alloys and synthetics may be employed.

Figure 5A:
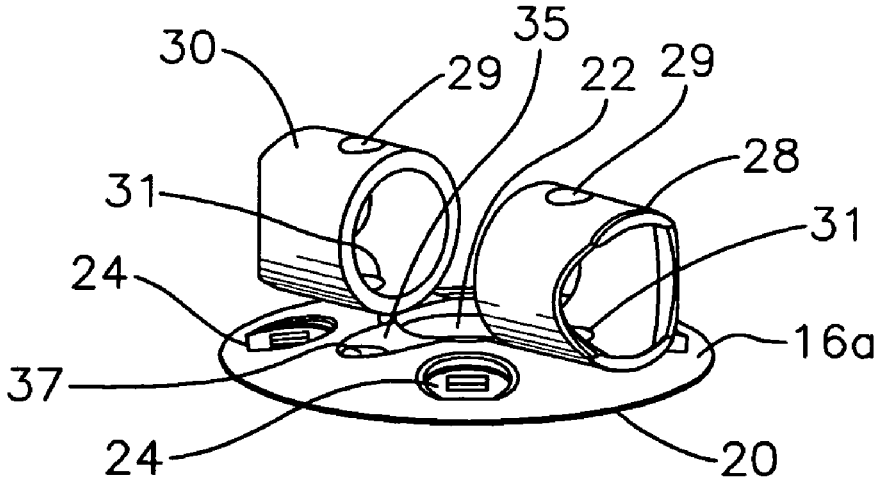
FIG. 5A is a perspective view of the anchor fixture employed in the system of this invention.
Figure 5B:
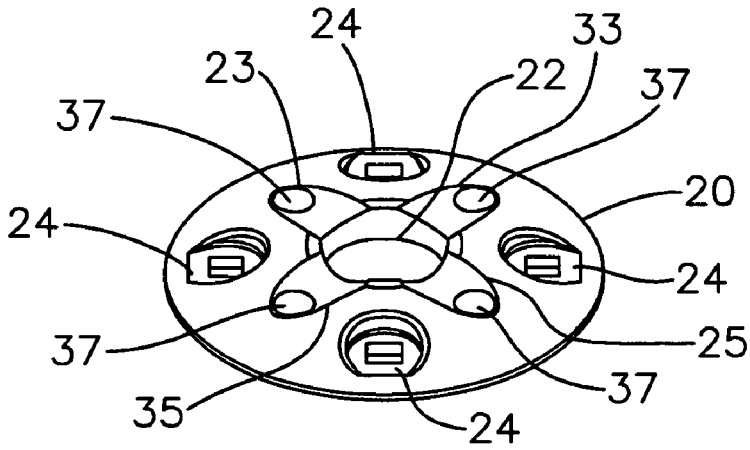
FIG. 5B is a perspective view of the base of the anchor fixture.

More particularly, fixture 16*a*, which is shown alone in FIG. 5A, includes a generally disk or circular shaped base 20 which, as best shown in FIG. 3, includes a flat lower surface and a convex upper surface. As central opening 22 is formed through the base and four attachment holes 24, FIGS. 2-5, are formed through the base for receiving respective connectors, namely fastening bolts 26. These bolts are employed to secure fixture 16*a* to the vessel as is described more fully below. Base 20 further features a first pair of aligned grooves 23, 25 that extend in the upper surface of the base radially from opposite sides of opening 22. Base 20 also includes a second opposing pair of radial grooves or recesses 33, 35 that extend from respective opposite sides of central opening 22 perpendicularly to grooves 23 and 25. Each of the radial grooves includes a pin locking hole 37, best shown in FIGS. 2, 4, 5A and 5B, proximate the distal or outer end thereof. The function of these pin locking holes is described more fully below.

As is further shown in FIGS. 2-5A, fixture 16*a* also features a pair of axially aligned and spaced apart tube segments 28, 30. Each of the tube segments has a generally cylindrical configuration. Tube segments 28 and 30 define an elongate tube extending across the upper surface of base 20. Each tube segment 28, 30 is received in a respective radial groove 23, 25 formed in the upper surface of base 20. Tube segments 28 and 30 are welded or otherwise permanently secured to base 20 within the respective radial grooves. Each of tube segments 28 and 30 includes a pair of diametrically opposed locking pin slots 29 and 31. See FIGS. 2, 4 and 5A. These aligned holes are themselves aligned with underlying pin locking holes 37 in the underlying grooves 23 and 25 of base 20, which respectively accommodate tube segments 28 and 30.

Figure 5C:
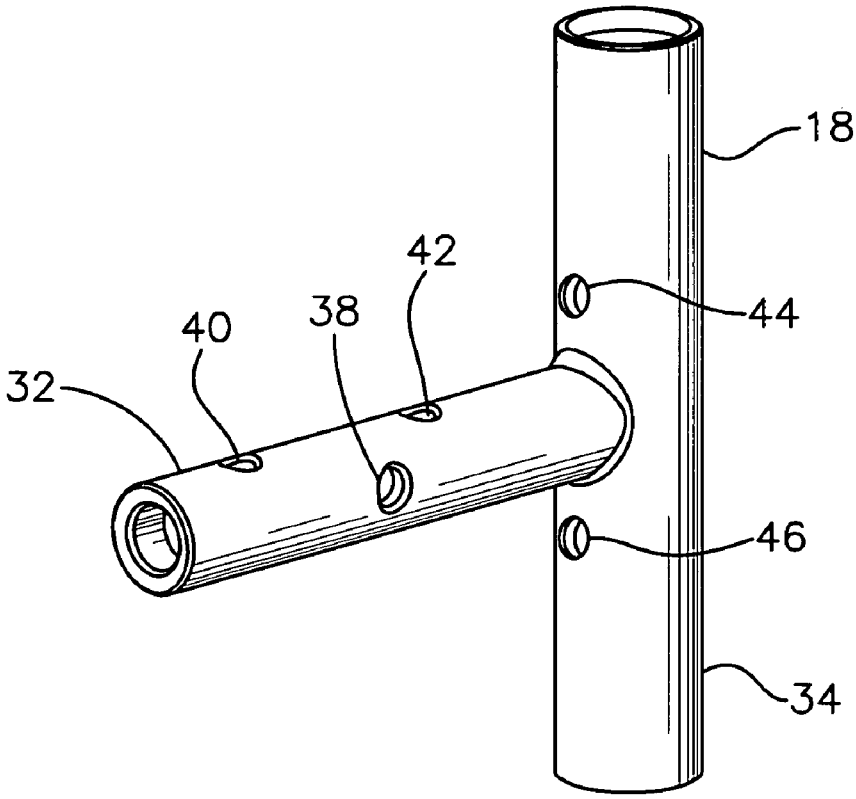
FIG. 5C is a perspective view of the adjustable pole holder.

As depicted in FIGS. 2-4, adjustable pole holder 18 includes an elongate tubular stem 32 having an elongate tubular sleeve 34 permanently and perpendicularly attached to a distal end thereof. Stem 32, shown alone in FIG. 5C, includes a pair of aligned holes 38 on respective sides of the stem. See also FIGS. 2-4. The stem also includes two pairs of aligned or diametrically opposed holes 40 and 42 formed through the top and bottom respectively of the stem. The top holes 40 and 42 are shown in FIG. 5C. However, the aligned holes formed through the bottom of the stem are obscured in that figure and in the remaining drawings. Stem 32 is permanently secured to sleeve 34 proximate a midpoint of the sleeve by means of welding or other means of attachment. Two pairs of aligned holes 44 and 46 are formed through diametrically opposed sides of sleeve 18.

In FIGS. 2-4, holder 18 is shown in a deployed condition relative to fixture 16*a*. In this condition, stem 32 slidably is received through aligned tubes 28 and 30 in fixture 16*a*. This orients sleeve 34 such that the longitudinal axis of sleeve 34 extends vertically. This allows the sleeve to support a push pole vertically in a manner that will be described more fully below. When the stem is inserted through the aligned tubes in this manner, aligned locking holes 40 in stem 32 are alignable with diametrically opposed locking holes 29 and 31 in tube 28. Aligned locking holes 42 in stem 32 are similarly alignable with diametrically opposed locking holes 29 and 31 in tube 30. This enables the stem to be locked into the aligned tubes of fixture 16*a*, for example, by inserting a locking pin 49 through the diametrically opposed locking holes in tube 30 and the corresponding aligned locking holes in stem 32 (i.e. holes 42 in FIG. 5C). The lower end of pin 49 also extends through the locking hole 37 located in groove 23 of base 20. (See locking hole 37 in FIG. 5B)

Figure 6:
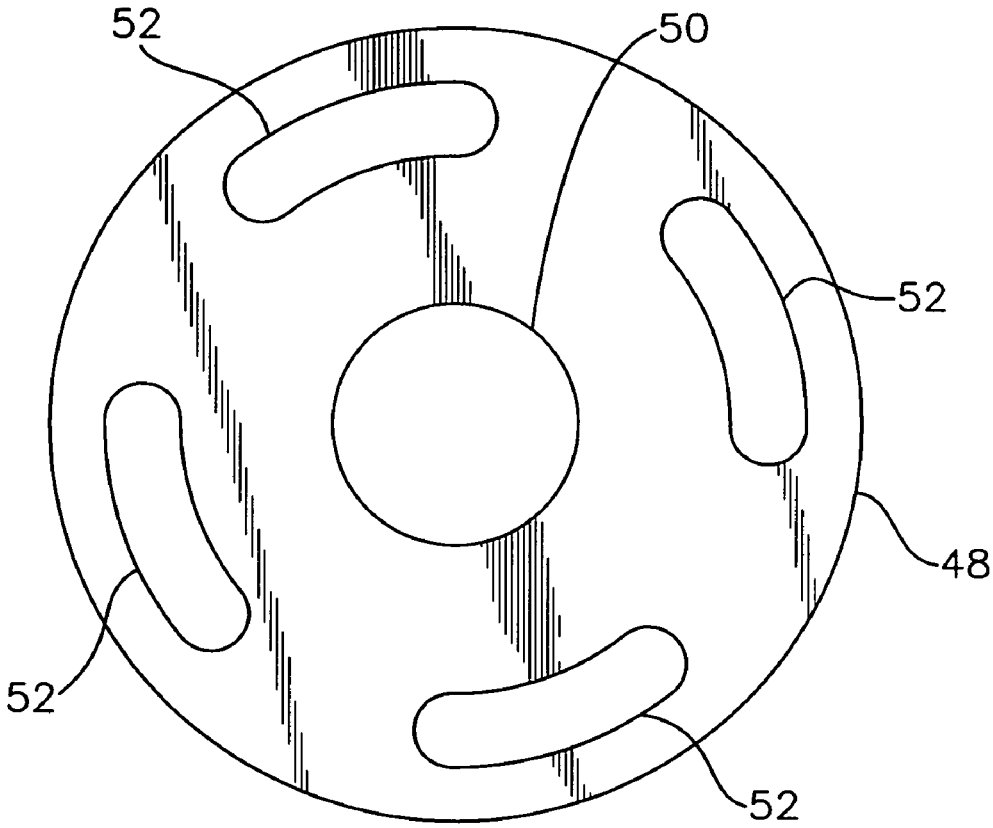
FIG. 6 is a top plan view of a representative shim that may be used in the anchoring system to adjust the angel and/or distance of which the base is mounted to the vessel.
Figure 7:
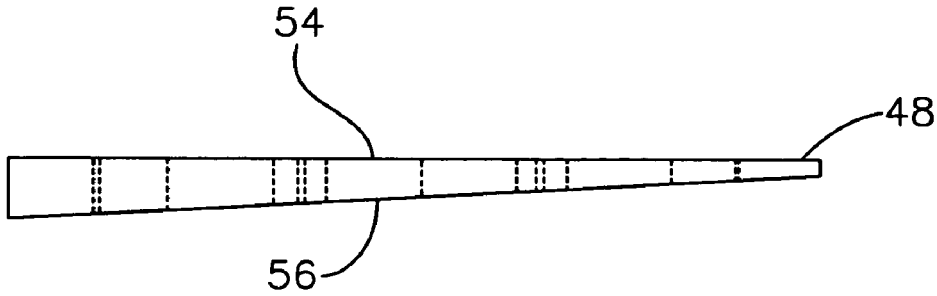
FIG. 7 is a side elevational view of the shim of FIG. 6.

Base 20 of anchor fixture 16*a* may be supported upon gunwale G or otherwise proximate the peripheral edge of boat 12 by one or more shims 48, FIGS. 2 and 3. A representative shim 48 is depicted in FIGS. 6 and 7. Each shim has a circular peripheral shape with a diameter that generally approximates that of base 20. See FIGS. 2 and 3. Each shim has a central opening 50 that corresponds to the central opening 22 in base 20. Each shim also includes a plurality of arcuate slots 52 for accommodating locking bolts 24, as best shown in FIG. 3, and for further accommodating an installed locking pin which will be described more fully below. As best shown in FIG. 7, each shim typically comprises a wedge having an inclined upper surface 54 that features an angle relative to lower shim surface 56. As best shown in FIGS. 2 and 3, a plurality of shims having upper surfaces of various selected inclinations may be superposed in a selected manner to adjust the angular orientation of pole holder 18 and, more particularly, the axial angle of sleeve 34. As is described more fully below, this allows the adjustable anchoring apparatus to compensate for angular variations in the deck or gunwale surface so that a pole is held vertically to achieve secure anchoring.

Apparatus 14 is secured to a generally horizontal surface of the gunwale, deck, hull or otherwise proximate the periphery of boat 12 by means of an interior mounting plate or bracket 58, which, as shown in FIG. 3, is secured to base 20 of fixture 16*a* by means of mounting bolts 26 and complementary nuts 60 that are threadably engaged with the mounting bolts. Bracket 58 is shown by itself in FIG. 8A. That bracket includes a central opening 62 that is aligned with the central opening 22 in base 20 and the central opening 50 in each of the optional shims 48 that are used. Bracket 58 also includes four bolt holes 64 that are aligned with corresponding bolt holes 24 in base 20, as well as arcuate slots 52 in shims 48.

Figure 8A:
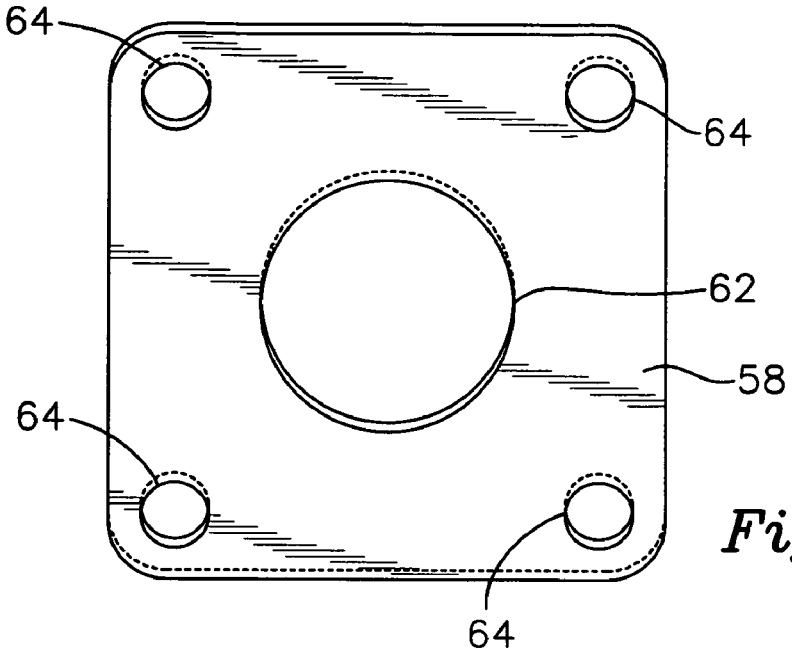
FIG. 8A is a perspective view of a representative mounting bracket.

Apparatus 14 is installed on boat 12 in the manner generally shown in FIG. 1 by first forming a hole in an upper, generally horizontal surface of the gunwale, deck, hull or other location proximate the peripheral edge of the boat. Holes are also formed through the horizontal surface of the vessel for accommodating the attachment bolts 26. Bracket 58, FIGS. 3 and 8A, is positioned interiorly against the horizontal surface of the vessel in the manner shown in FIG. 8B. For example, bracket 58 is engaged flushly against the interior horizontal surface 66 of gunwale G such that the central opening 62 and attendant holes 64 in bracket 58 are aligned with the corresponding holes cut in the vessel. Bracket 58 may be inserted through any available opening or means of access through the gunwale, deck or other mounting surface of the vessel. In some boats, the underside of the gunwale is open and accessible from the interior of the boat. In other cases, accessories such as a fishing rod holder may be removed to allow installation of bracket 58. Anchor fixture 16*a*, FIGS. 1, 2-4 and 5A, is then positioned exteriorly on the gunwale or other horizontal mounting surface such that the openings and holes in base 20 align with the corresponding openings in bracket 58. The attachment bolts 26 are then engaged with bolt holes 24, the aligned receptacles of underlying shims 48, the bolt accommodating holes formed through the gunwale or other horizontal vessel surface and the attachment holes 64 in interior mounting bracket 58. Nuts 60 are threadably attached to the respective bolts 26 and tightened to secure the entire apparatus in place on the vessel as shown in FIGS. 2-4, 8B and 9. It should be noted that FIG. 8B also depicts stem 32 extending through the central opening 62 of bracket 58. This illustrates the placement of the stem when apparatus 14 is in the stowed condition as is described more fully below.

Figure 8B:
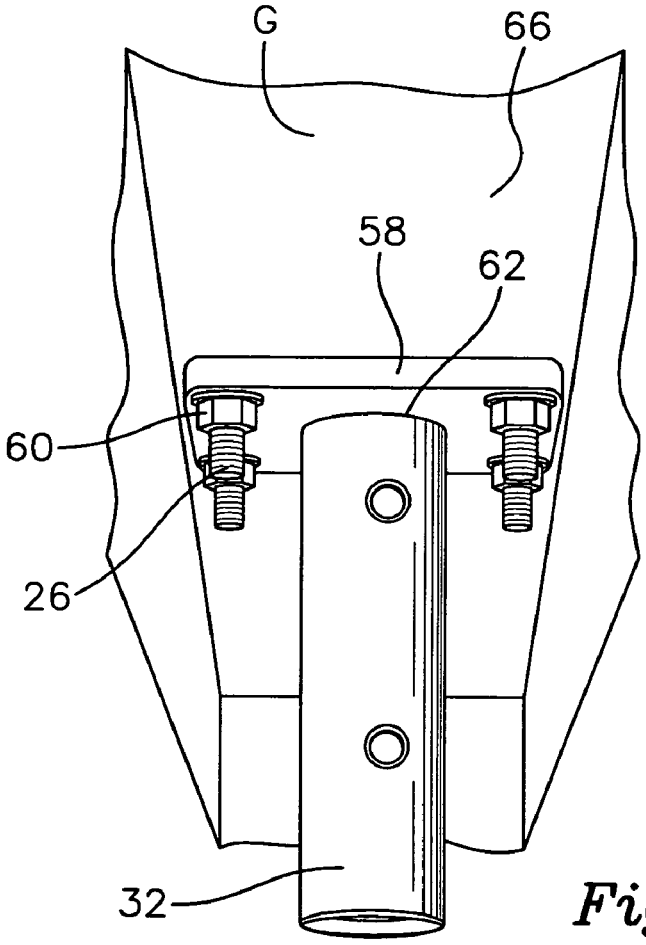
FIG. 8B is a perspective view of the mounting bracket mounted interiorly to the gunwale and receiving the stem of the pole holder through a central opening thereof when the holder is in the stowed position.
Figure 9:
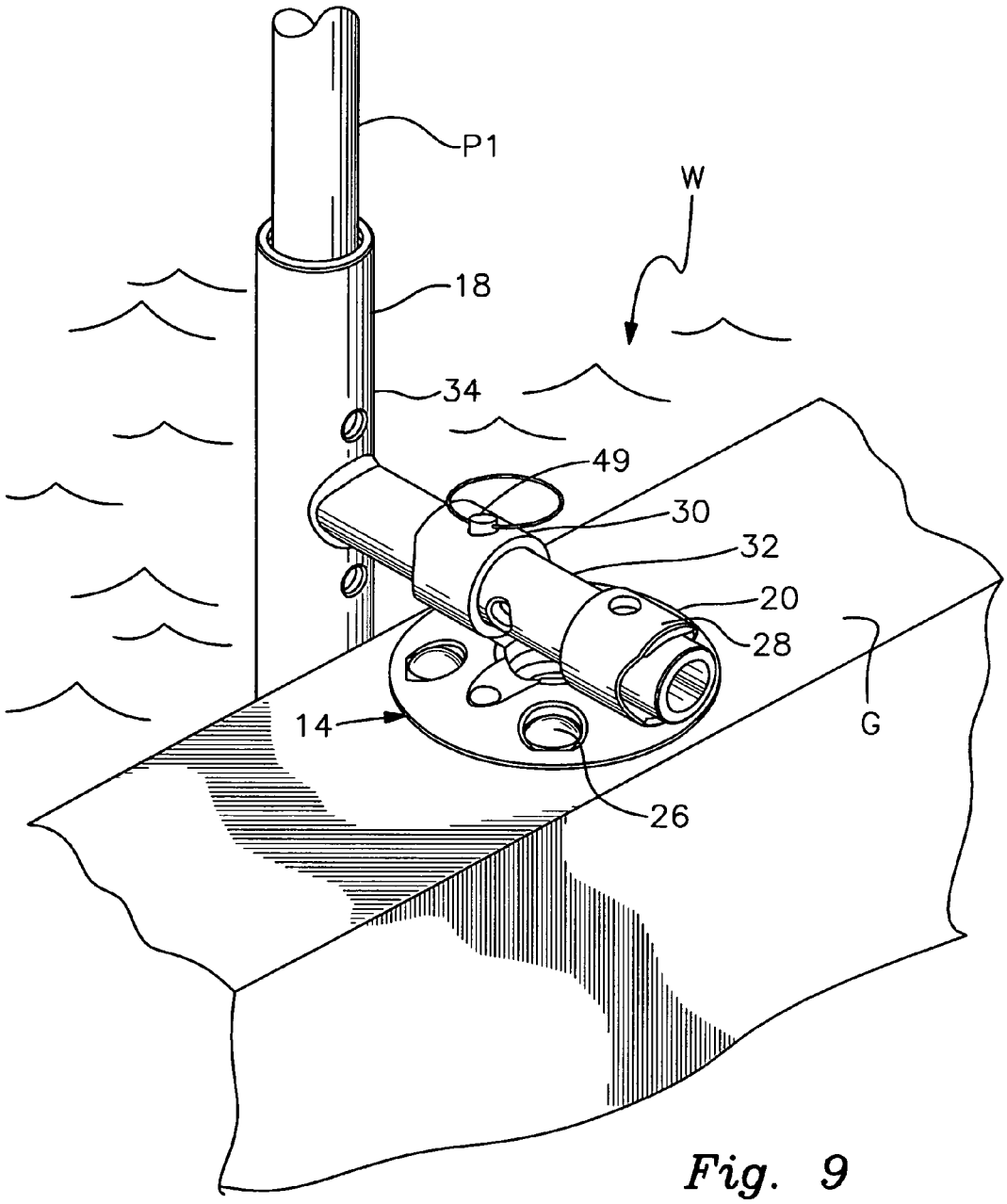
FIG. 9 is a perspective view of the apparatus of FIGS. 2-4 as installed on a boat and with an anchoring push pole accommodated therein and deployed in an anchoring condition for engaging the bottom of a body of water and helping to anchor the boat thereto.

FIG. 9 shows apparatus 14 fixed to the horizontal surface of gunwale G with pole holder 18 in a deployed condition. In this drawing, the optional shims are omitted for clarity. However, it should be understood that such shims may be selected and arranged as needed to adjust the angular orientation of the longitudinal axis of sleeve 34. Base 20 is securely fastened to the horizontal surface of gunwale G by means of bolts 26 that extend through the openings in base 20 and through the gunwale to threadably engage underlying mounting bracket 58 (FIG. 8B). Holder 18 is deployed by rotating stem 32 within aligned tube segments 28 and 30 until the longitudinal axis of sleeve 34 is oriented in a generally vertical direction. More particularly, the diametrically opposed and aligned holes 42 (FIG. 5C) in stem 32 are aligned with diametrically opposed holes 29 and 31 in tube 30 (see FIG. 5A). Locking pin 49 is then engaged with the aligned holes to lock the holder in place with sleeve 18 having a vertical axial orientation. Push pole P1 is then inserted through sleeve 15 and is extended downwardly through the underlying body of water W. The lower end of the push pole is forced into the bottom B in the manner shown in FIG. 1 such that boat B is anchored to the bottom.

Figure 10:
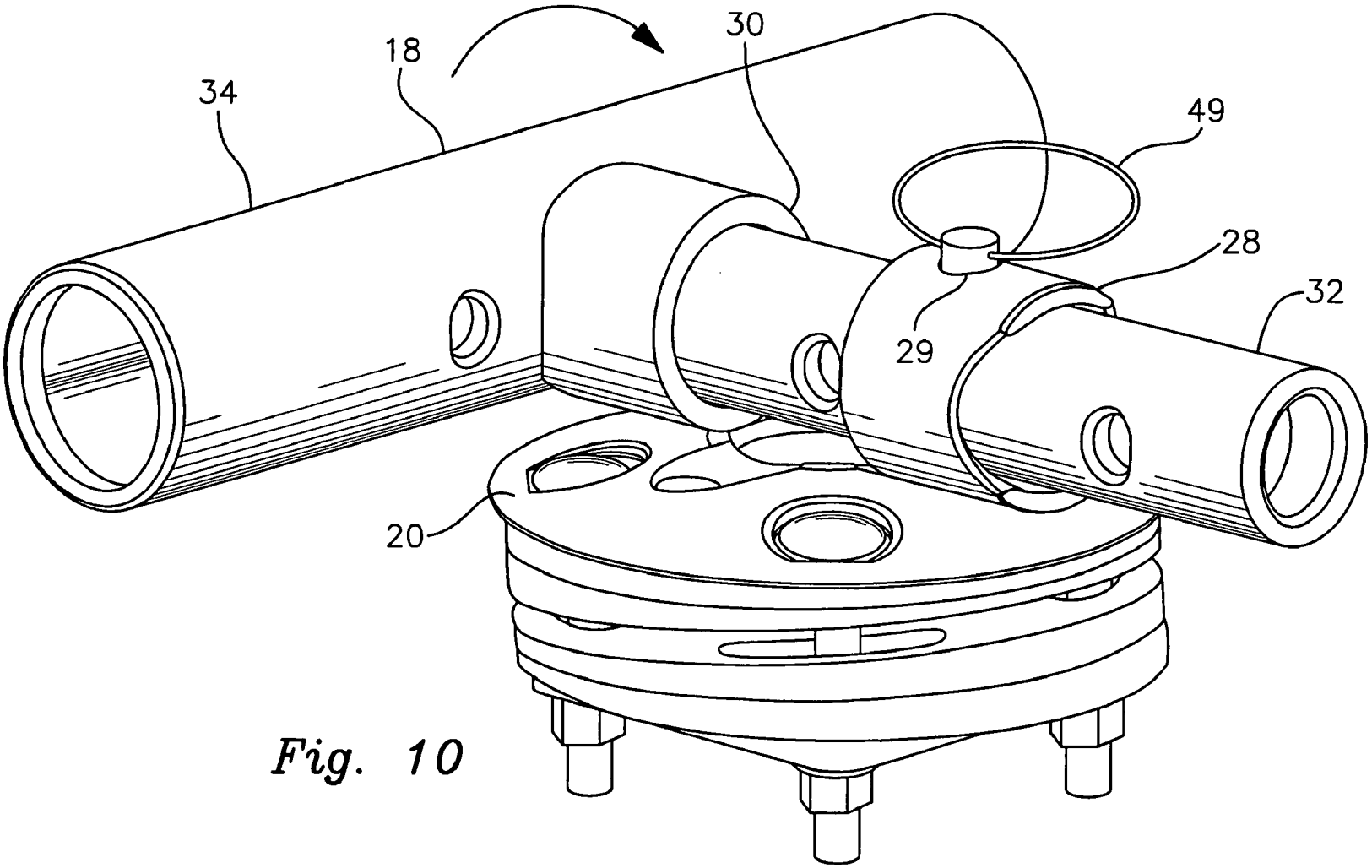
FIG. 10 is a perspective view of the anchoring apparatus of FIGS. 2-4 and 9 with the pole holder locked in a transporting position.

FIG. 10 depicts adjustable pole holder 18 in an alternative position for transporting the pole. This position is achieved by simply rotating the pole holder 90° relative to the position shown in FIGS. 2-4 and 9. In particular, to adjust the pole holder from the anchoring position shown in FIG. 9 to the transporting position, the user simply removes locking pin 49 by pulling it out of the interengaged stem 32 and tube 30. The user then rotates sleeve 34 approximately 90° by turning stem 32 within aligned tube segments 28 and 30, as shown in FIG. 10. Although no pole is depicted within sleeve 34, it should be understood that during such rotation, the pole may remain in the sleeve. In any event, after the stem and sleeve have been rotated relative to the aligned tube segments 28 and 30, the aligned locking holes 38 (FIG. 5C) in stem 32 are aligned with the diametrically opposed holes 29 and 31 in tube segment 28. Insertion pin 49 is then reinserted through these holes and into the hole of the underlying base 20 to lock holder 18 in the transporting position. The holder is maintained in this position while the boat is repositioned in the water. When the vessel (not shown in FIG. 10) has achieved a new desired location, the anchor apparatus can be redeployed into the condition shown in FIGS. 2-4 and 9 so that pole P1 can be securely re-engaged with the bottom of the body of water to help in anchoring the vessel.

Figure 11:
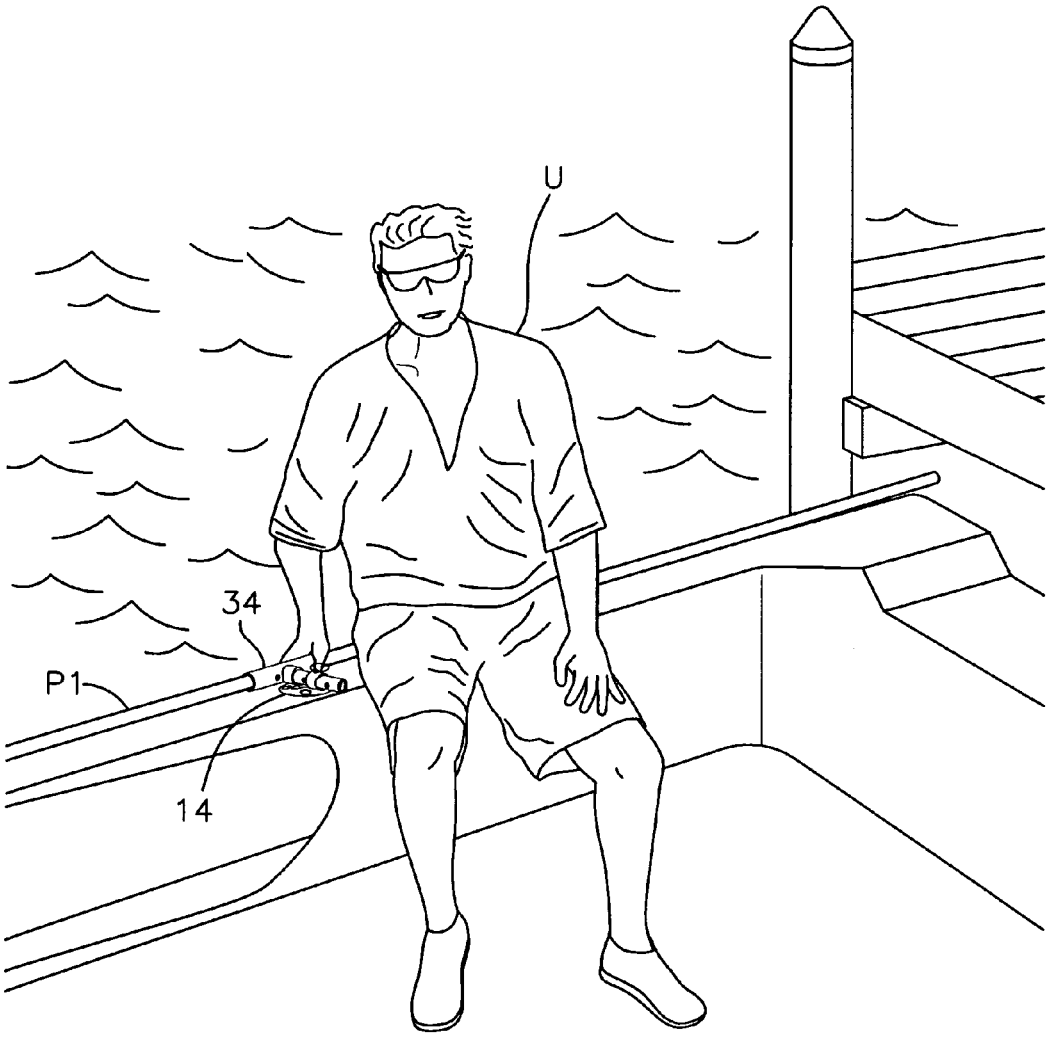
FIG. 11 is a perspective view of the anchoring apparatus as installed in a boat and locked in the transporting condition of FIG. 10 with a standard push pole received by the sleeve of the apparatus.

FIG. 11 illustrates apparatus 14 with the holder locked in the transporting position wherein sleeve 34 receives pole P1. During transport of the push pole and repositioning of the vessel, a user U can manually hold the push pole in place so that it does not inadvertently slide out of sleeve 34. This permits push pole P1 to be transported to a new anchoring location and redeployed as shown in FIGS. 1, 2-4 and 9.

Figure 12:
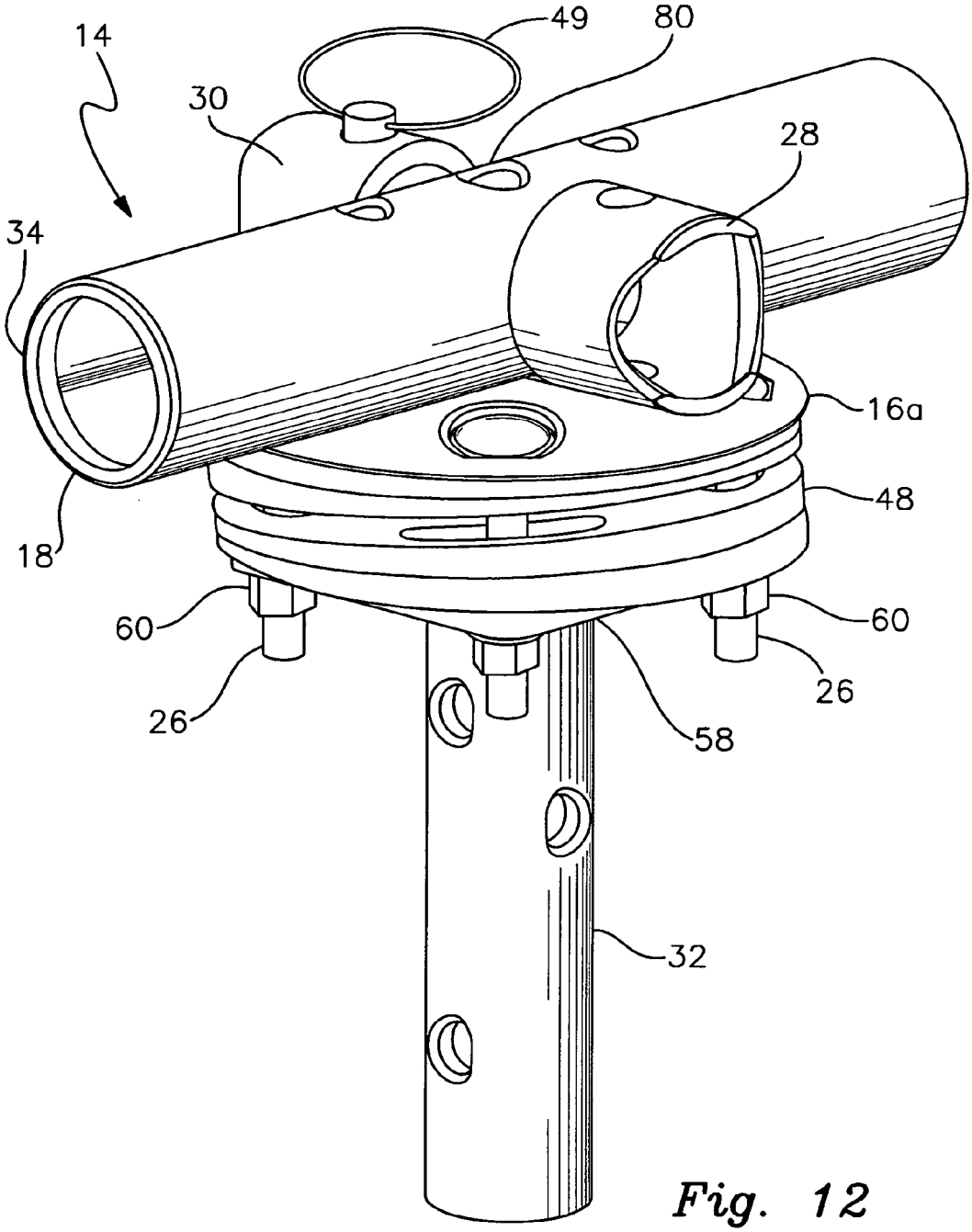
FIG. 12 is a perspective view of the anchoring apparatus of FIGS. 2-4 and 9-11 with the push pole removed and the holder in a stowed condition within the anchor fixture.

Anchoring apparatus 14 is depicted in FIG. 12 with adjustable pole holder 18 in a stowed condition. The pole holder is placed in this condition when the boat is not in use or while the boat is being navigated to or from a selected fishing location. Anchor fixture 16*a*, shims 48 and interior bracket 58 are mounted to the vessel (not shown) and held together by fastening bolts 26 and attached nuts 60 in the manner previously described. As further illustrated in FIG. 13, this secures fixture 16*a* to the horizontal surface of gunwale G or other proximate the peripheral edge of the boat. T-shaped pole holder 18 is disengaged from its previously described position wherein stem 32 is received by aligned tube segments 28 and 30. Specifically, the pole holder is disengaged from the aligned tube segments by pulling locking pin 49 upwardly and releasing the locking pin from stem 32 and either tube 28 segment or tube segment 30 (depending upon which of the tube segments has been engaged by pin 49). Stem 32 is slid out of the aligned tube segments and inserted through the central opening (see opening 22 in FIG. 5B) of base 20, in the manner depicted in FIGS. 12 and 13. As further shown in FIG. 8B, stem 32 extends through the cutout formed in surface 66 of gunwale G and through the central opening 62 of interior mounting bracket 58. The lower end of stem 32 thereby extends interiorly into the gunwale or hull of the vessel. Sleeve 34 of holder 18 extends through the gap or slot 80 formed between tube segments 28 and 30. The sleeve is received or nests in the aligned grooves 33 and 35 (FIGS. 5A, 5B) of base 20. As a result, the pole holder 18 is securely stowed in the manner best shown in FIG. 13. Push pole P1 may remain within sleeve 34 and extend along an upper surface of gunwale G. The push pole is thus stowed securely along the gunwale when use of the push pole is not required for either anchoring or pushing/maneuvering the vessel.

Optionally, locking pin 49 may be engaged with one of the holes 44, 46 in sleeve 34 and with an aligned, underlying one of the holes 27 formed in grooves 33 and 35 of base 20 (refer again to FIG. 5B). This further secures the pole holder 18 relative to the anchor fixture and gunwale. However, generally because sleeve 34 is received fairly snugly between fixed tube segments 28 and 30, the pole holder is held relatively securely even without the engagement of pin 49 with holder 18 in the stowed condition.

Accordingly, pole holder 34 and an engaged push pole P1 may be quickly and conveniently alternated between the anchoring position (FIGS. 1, 2-4 and 9) for anchoring the boat, the transporting position (FIGS. 10 and 11) for allowing the vessel and the push pole to be moved from one anchoring location to a different anchoring location, and the stowed position (FIGS. 8B, 12 and 13) for allowing the push pole and adjustable anchor apparatus to be stowed when not needed. The anchor apparatus is versatile and very easy to operate.

Figure 14:
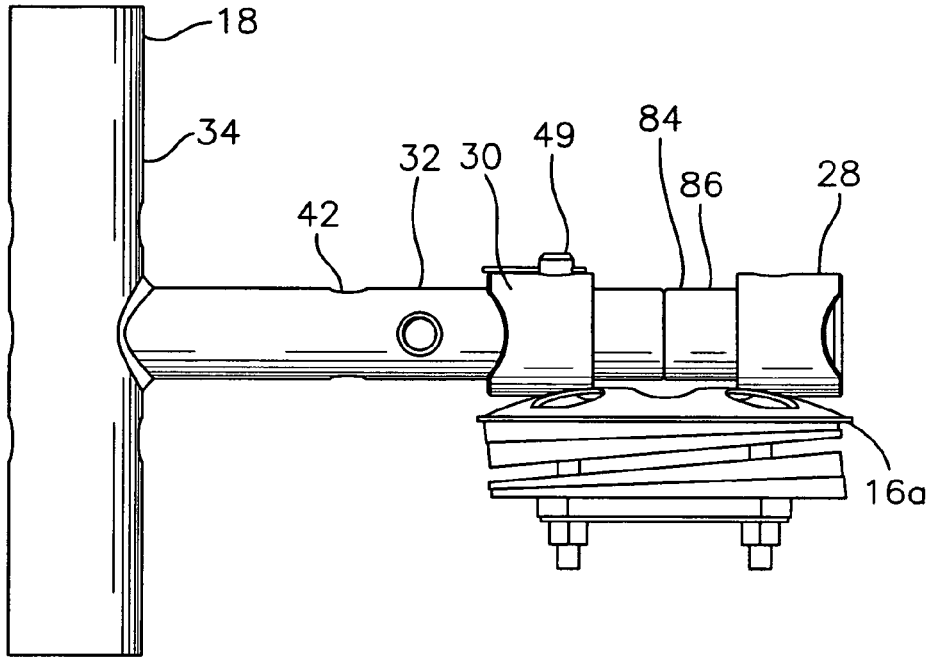
FIG. 14 is an alternative side view of the previously depicted anchoring apparatus and further including a stem extension that allows the pole mounting sleeve to be extended outwardly from the peripheral edge of the vessel.
Figure 15:
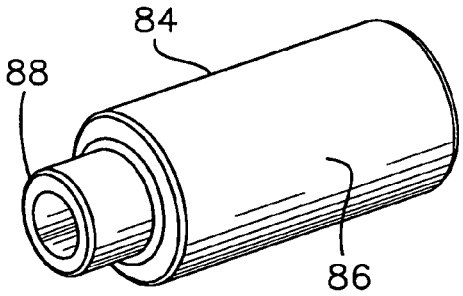
FIG. 15 is a perspective view of the stem extension.
Figure 16:
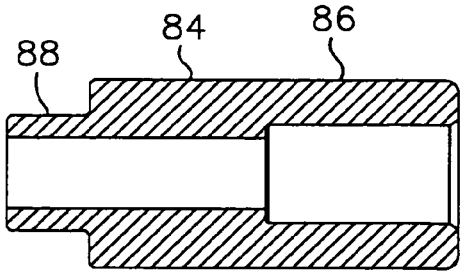
FIG. 16 is a cross sectional side view of the stem extension.

In the anchoring position, push pole P1 is held a distance outwardly from the edge of the vessel determined by the distance that the stem 32 extends beyond tube segment 30. The sleeve may be positioned at somewhat greater distance outwardly of the vessel by employing a stem extension 84, shown in FIG. 14. The stem extension 84, shown alone in FIGS. 15 and 16, comprises a generally cylindrical portion 86 having a diameter that corresponds to the diameter of stem 32. A reduced diameter attachment insert 88 is attached unitarily to and extends from one end of cylindrical portion 84. Insert 88 has a diameter that permits it to fit snugly within the axial bore of stem 32. Accordingly, by introducing insert 88 into the bore of stem 32, stem extension 84 is attached and substantially aligned with stem 32 in the manner shown in FIG. 14. This provides holder 18 with an extended stem. When the extended stem is aligned with the tube segments 28 and 30, in the manner shown in FIG. 14, and the holder is in the anchoring position, locking hole 40 of stem 32 (see FIG. 5C) is moved outwardly so that it is aligned with the hole 29 in tube segment 30. Pin 49 is then engaged with these aligned locking holes and is further engaged with the diametrically opposed aligned locking holes in the stem and tube segment, as well as the underlying hole 27 (see FIG. 5B) in groove 23 of base 20. Stem extension 84 extends from stem 32 and is received by tube segment 28. As a result, the stem 32 extends a greater distance outwardly from the edge of the vessel and sleeve 34 is likewise extended outwardly a greater distance from the peripheral side of the boat.

The stem extension described above allows the pole holder and sleeve to be positioned far enough outwardly of the anchor fixture so that the pole holder can be operated effectively without interfering with the edge of the vessel or particular structural attachments to the vessel. This also allows the anchoring apparatus to be attached at a convenient location on the hull/deck/gunwale and provides adequate clearance for the sleeve and accommodated push pole. This effectively rectifies situations where a standard stem length would not provide such clearance.

As further shown in FIG. 1, anchoring system 10 also includes an anchoring fixture 16 that is secured to the transom or other portion of the hull proximate the stern of the vessel. As previously indicated, anchor fixture 16 is constructed identically or very similarly to previously described anchor fixture 16*a*. In particular, as illustrated in FIG. 17, anchor fixture 16 includes a base 20 that carries a pair of aligned tube segments 28 and 30. which extend across the base. Base 20 is fastened to transom T by four mounting bolts 26 that are secured to an interior bracket mounted on the inside of the transom in a manner analogous to the manner in which bracket 58 is mounted interiorly to the horizontal surface of gunwale G in FIG. 8B. This bracket is typically installed into the hull through a port hole or other opening (not shown), which is commonly available on most boats.

As shown in FIGS. 1 and 17, anchor fixture 16 is mounted exteriorly to transom T such that the longitudinal axis of tube segments 28 and 30 is oriented in a generally vertical direction. The tube segments have a diameter that allows the tube segments to receive a second standard push pole P2 as shown in FIG. 1. This push pole is inserted downwardly through the aligned tube segments 28 and 30 and extended into the shallow body of water W. The user then urges push pole P2 into the bottom B to help anchor the vessel in place.

As shown in FIG. 18, in some cases the transom is angled or inclined. Accordingly, a plurality of shims 48, as previously described, may be interposed, in the manner shown in FIG. 18, between transom T and base 20 of anchor fixture 16. One or more shims are selected and stacked to orient the tube segments 28 and 30 at a selected, and preferably a substantially vertical axial angle. Stacking shims in this manner also allows the distance that pole P2 is held outwardly from the stern of the vessel to be adjusted and set as needed. By selecting and rearranging shims 48, the angular orientation of the aligned tube segments and accommodated push pole P2 can be conveniently adjusted (i.e. the upper end of the push pole can be tilted toward or away from the transom of the vessel). The shims can also be used to adjust the clearance between the push pole P2 and the stern of the boat.

In operation, anchor apparatus 14 and transom mounted anchor mounted fixture 16 are secured to gunwale G and transom T respectively in the previously described manner. During storage or docking of the vessel or while the boat travels to a particular destination for fishing, adjustable pole holder 18 remains in the stowed condition shown in FIGS. 12 and 13. When the boat arrives at its desired fishing location, it is quickly and conveniently anchored. Adjustable pole holder 18 is removed from the stowed condition and installed in the deployed, anchored position as shown in FIGS. 1, 2-4 and 9. Push pole P1 is inserted through sleeve 18 and engaged with bottom B of body of water W. A second push pole P2 is likewise slid through the aligned tube segments 28 and 30 of transom mounted anchor fixture 16. Push pole P2 is extended through the body of water W and likewise driven forcefully into bottom B. The two push poles P1 and P2, which have been driven into the bottom B, anchor boat 12 securely in place and prevent unintended drift while the occupants engage in fishing or otherwise while the boat remains anchored. The use of a second push pole P2 to anchor the boat is especially effective in preventing the stern and the bow from drifting relating to the position established by pole P1.

Subsequently, if the boat must be repositioned, push poles P1 and P2 are quickly and easily disengaged from bottom B. In particular, the locking pin 49 is disengaged and the pole holder 18 rotated 90° to lift push pole P1 out of the water. Push pole P2 is simply lifted vertically upwardly through the aligned tube segments of anchor fixture 16 and disengaged from bottom B. After a new anchoring position is reached, the push poles are then redeployed to re-anchor the vessel. In particular, pole holder 18 is rotated from the transport position to the anchoring position and pole P1 is reengaged with bottom B. Pole P2 is simply re-lowered through anchor fixture 16 and reengaged with the bottom of the body of water. The boat is thereby securely anchored.

Figure 13:
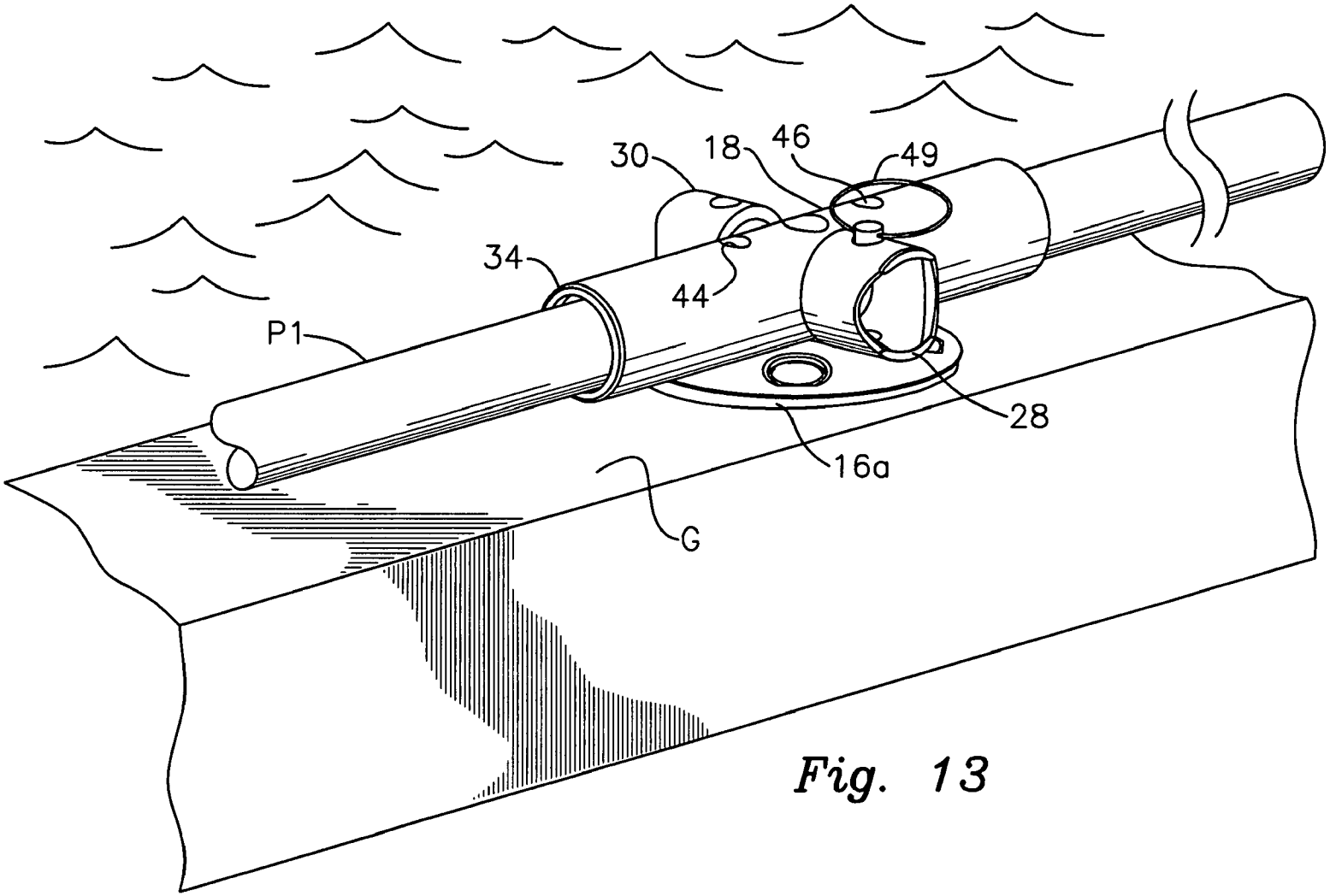
FIG. 13 is a perspective view of the anchoring apparatus of FIGS. 2-4 and 9-12 with the holder in a stowed condition and a push pole received in the stowed sleeve.

When anchoring is no longer required, holder 18 of apparatus 14 is returned to the stowed condition as shown in FIG. 13 and pole P2 is removed from anchor fixture 16 and stored within the vessel. Both fixtures 16, 16*a* remain attached to the vessel The anchoring system of this invention is quick and easy for virtually any boater to operate. The system is extremely effective for use in anchoring fishing boats and other types of sport boats particularly in shallow water locations. The undue time and effort associated with deploying and retrieving conventional anchors are avoided. Because traditional anchors are not used, there is less chance that the boat will become tangled with or stuck in underwater plants or debris. Moreover, anchor lines are totally eliminated, which solves the prior problem of fishing lines being tangled with or broken by such anchor lines.

From the foregoing it may be seen that the apparatus of this invention provides for a boat anchoring system and, more particularly, to an apparatus for use in combination with one or more elongate push poles to anchor a fishing boat or other relatively shallow water vessel to the bottom of a body of water. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. An apparatus for use in combination with an elongate pole to anchor a marine vessel to the bottom of a body of water, said apparatus comprising:

an anchor fixture including a base and a tube carried by and extending across said base; said base being mountable exteriorly proximate a peripheral edge of the vessel with a longitudinal axis of said tube oriented to extend in a generally horizontal direction; said base having a central opening that is communicably alignable with an underlying opening in the vessel; and an adjustable pole holder including an elongate stem and an elongate pole mounting sleeve joined and extending laterally relative to said stem, said pole holder being selectively alternatable between a stowed condition wherein said stem is inserted through said central opening and into the underlying opening in the vessel and said sleeve extends laterally relative to said tube and a deployed condition wherein said stem is inserted through said tube and said sleeve is held for receiving the elongate pole, said tube including a pair of axially aligned and spaced apart tube segments disposed on respective sides of said central opening, said sleeve extending between said tube segments in the stowed condition.

2. The apparatus of claim 1 in which said stem is rotatable in said tube in said deployed condition to selectively alternate said sleeve, with a pole received therein, between a generally horizontal axial orientation for transporting the pole and a generally vertical orientation for engaging the pole with the bottom of the body of water and anchoring the vessel thereto.

3. The apparatus of claim 1 in which said stem and said sleeve include respective tubular configurations.

4. The apparatus of claim 1 in which said stem and said sleeve are perpendicularly interconnected.

5. The apparatus of claim 2 in which said anchor fixture and said stem include corresponding anchor position locking slots which are alignable for receiving a locking pin to maintain said holder in an anchoring position with said sleeve in a generally vertical axial orientation.

6. The apparatus of claim 2 in which said anchor fixture and said stem include corresponding transporting position locking slots that are alignable for receiving a locking pin to maintain said holder in a transporting position with said sleeve in a generally horizontal axial orientation.

7. The apparatus of claim 1 further including a stem extension releasably connected to and axially aligned with said stem for being received by said tube to support said sleeve a selected extended distance outwardly of the edge of the vessel.

8. The apparatus of claim 1 in which said tube segments have a cylindrical configuration.

9. The apparatus of claim 1 further including a mounting bracket that interiorly engages the vessel and is secured to said base by one or more connectors that extend through said vessel.

10. The apparatus of claim 1 further including at least one shim element for interposing between the base and the vessel to adjust the angular orientation of said sleeve.

11. The apparatus of claim 7 in which said stem extension includes a reduced diameter insert that is receivable in an axial bore of said stem to join said stem extension to said stem.

12. The apparatus of claim 10 in which said shim element includes an inclined wedge.

13. An apparatus for use in combination with an elongate pole to anchor a marine vessel to the bottom of a body of water, said apparatus comprising:

an anchor fixture including a base and a tube carried by and extending across said base; said base being mountable exteriorly proximate a peripheral edge of the vessel with a longitudinal axis of said tube oriented to extend in a generally horizontal direction; said base having an opening formed therethrough that is communicably alignable with an underlying opening in the vessel; and an adjustable pole holder including an elongate stem and an elongate pole mounting sleeve joined and extending laterally relative to said stem, said pole holder being selectively alternatable between a stowed condition wherein said stem is inserted through said opening formed through said base and into the underlying opening in the vessel and said sleeve extends laterally relative to said tube and a deployed condition wherein said stem is inserted through said tube and said sleeve is held for receiving the elongate pole, said tube including a pair of axially aligned and spaced apart tube segments disposed on respective sides of said opening formed through said base, said sleeve extending between said tube segments in the stowed condition.

* * * * *